US005586599A

United States Patent [19]

Sj¨ostr¨om

[11] Patent Number: 5,586,599

[45] Date of Patent: Dec. 24, 1996

[54] HEAT EXCHANGER

[75] Inventor: Anders Sjöström, Lund, Sweden

[73] Assignee: Tetra Laval Holdings & Finance SA, Pully, Switzerland

[21] Appl. No.: 323,687

[22] Filed: Oct. 17, 1994

[30] Foreign Application Priority Data

Oct. 21, 1993 [SE] Sweden ..... 9303466
Jun. 10, 1994 [SE] Sweden ..... 9402029

[51] Int. Cl.[6] ..... F28F 9/26

[52] U.S. Cl. ..... 165/143; 165/81

[58] Field of Search ..... 165/81, 143, 144

[56] References Cited

U.S. PATENT DOCUMENTS

| | | | |
|---|---|---|---|
| 635,955 | 10/1899 | Campbell . | |
| 663,602 | 12/1900 | Deming . | |
| 710,810 | 10/1902 | Schneible . | |
| 826,966 | 7/1906 | Schneible . | |
| 1,037,798 | 9/1912 | Rumpf . | |
| 1,067,505 | 7/1913 | Dalzell et al. | 165/143 |
| 1,581,384 | 4/1926 | Chester . | |
| 1,597,479 | 8/1926 | Price . | |
| 1,602,552 | 10/1926 | Richey et al. . | |
| 1,638,806 | 8/1927 | Hilliard . | |
| 1,790,151 | 1/1931 | How | 165/143 X |
| 1,918,601 | 7/1933 | Jacocks et al. | 165/143 X |
| 2,713,996 | 7/1955 | Pottharst, Jr. | 165/143 |
| 2,859,948 | 11/1958 | Callard . | |
| 3,249,153 | 5/1966 | Holland | 165/143 X |

FOREIGN PATENT DOCUMENTS

| | | |
|---|---|---|
| 18836 | 12/1901 | Sweden . |
| 156861 | 11/1956 | Sweden . |

*Primary Examiner*—Allen J. Flanigan
*Attorney, Agent, or Firm*—Burns, Doane, Swecker & Mathis, L.L.P.

[57] ABSTRACT

The invention relates to a heat exchanger of the type which is constructed from a number of heat exchanger elements (1) consisting of a tubular jacket (2) with thermal transfer tubes (3) lying within the jacket. The heat exchanger elements (1) are joined together to form a heat exchanger, in that each end of a heat exchanger element is provided with a modular unit (4) which constitutes the frame of the heat exchanger. A jacket connection (5) is connected to each two modular units (4) and constitutes an extension of the tubular jacket (2). The jacket connection (5) is designed as an H pipe.

16 Claims, 7 Drawing Sheets

HEAT EXCHANGER

FIELD OF THE INVENTION

The present invention relates to a heat exchanger and more particularly a heat exchanger of a type having modular units which may be combined to form a complete heat exchanger unit.

BACKGROUND ART

Heat exchangers, of which there are numerous types, are employed to heat or cool a liquid product. Using, for example, steam or water at different temperatures, it is possible to heat or cool a product, which is preferably liquid to the desired level. Heat exchangers are put into use within various process industries and are also common occurrences within food industries such as, for example, dairies.

One well-known type of heat exchanger is the so-called tube heat exchanger which consists of one or more heat exchanger elements which are interconnected into a flow system. The heat exchanger elements include one or more thermal transfer tubes surrounded by an outer tubular jacket. The thermal transfer tubes are interconnected to form a product flow insert which, in turn, is interconnected by means of product elbow pipes so as to circulate the product which is to be heated or cooled depending upon the process for which the heat exchanger is employed. The thermal transfer tubes lie enclosed in a tubular jacket that surrounds the thermal transfer medium which may consist of water at different temperatures, steam or other types of liquids or gases. This type of heat exchanger is, however, complex and expensive to produce. It requires exact fit of connections, at the same time as demanding a certain degree of play on being mounted in a frame, since the tubes in the heat exchanger are subjected to thermal expansion which may give rise to extreme inner stresses in both tubes and frame.

It has previously proved difficult to produce a modular version of a heat exchanger of the tube type, since each heat exchanger requires its own individual design. A tube heat exchanger of traditional type is complex to assemble and, on replacement of spare parts, extensive dismantling is often required for replacing individual parts.

SUMMARY OF THE INVENTION

One object of the present invention is to join together the elements included in the heat exchanger such that the heat exchanger will be simple to assemble and such that those parts which constitute the heat exchanger will be easy to standardise and modularise in that a small number of parts of which the heat exchanger consists constitutes both the frame and connection conduits for product flow and thermal transfer medium.

A further object of the present invention is to realise a simplified and more economical design and construction, which entails fewer spare parts and which obviates the problems inherent in the replacement of individual spare parts in a previously assembled heat exchanger.

These and other objects have been attained according to the present invention in that the heat exchanger of the type described by way of introduction has been given the characterizing features that each tubular jacket is connected at its ends to a modular unit which is disposed to support the heat exchanger elements; that one jacket connection is disposed to be connected to two neighbouring modular units, each jacket connection comprising tubular elements, communicating with a tubular jacket respectively, the tubular elements are interconnected with a connecting element and that the heat transfer tubes in each of two neighbouring heat exchanger elements are connected by a product elbow pipe.

BRIEF DESCRIPTION OF THE PREFERRED EMBODIMENT

One preferred embodiment of the present invention will now be described in greater detail hereinbelow, with particular reference to the accompanying Drawings, in which.

The Drawings show only those details essential to an understanding of the present invention.

DETAILED DESCRIPTION OF THE PREFERRED EMBODIMENT

Figure 1:
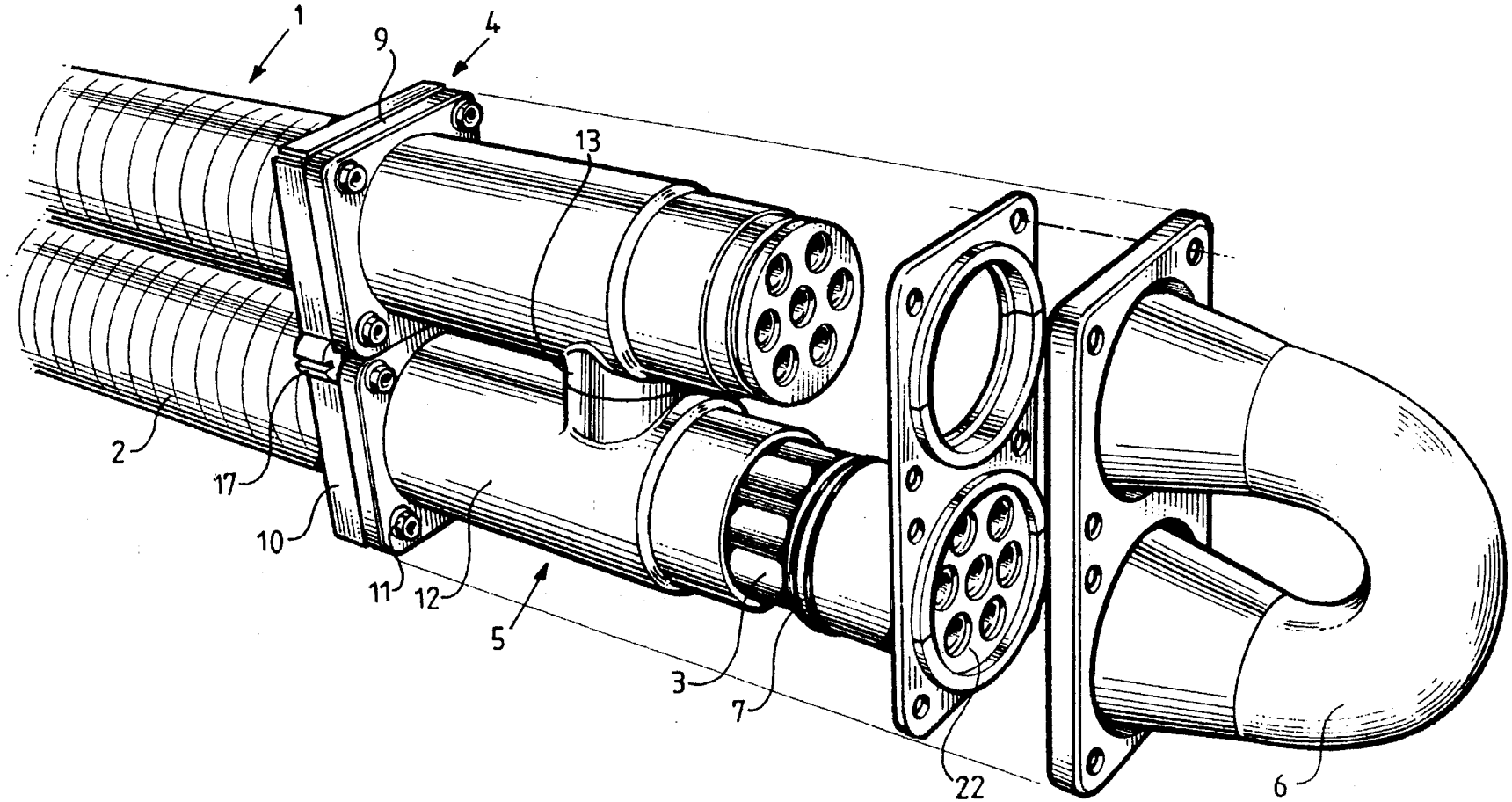
FIG. 1 is a schematic overview of a portion of a heat exchanger according to the present invention, partly as an exploded view.
Figure 2:
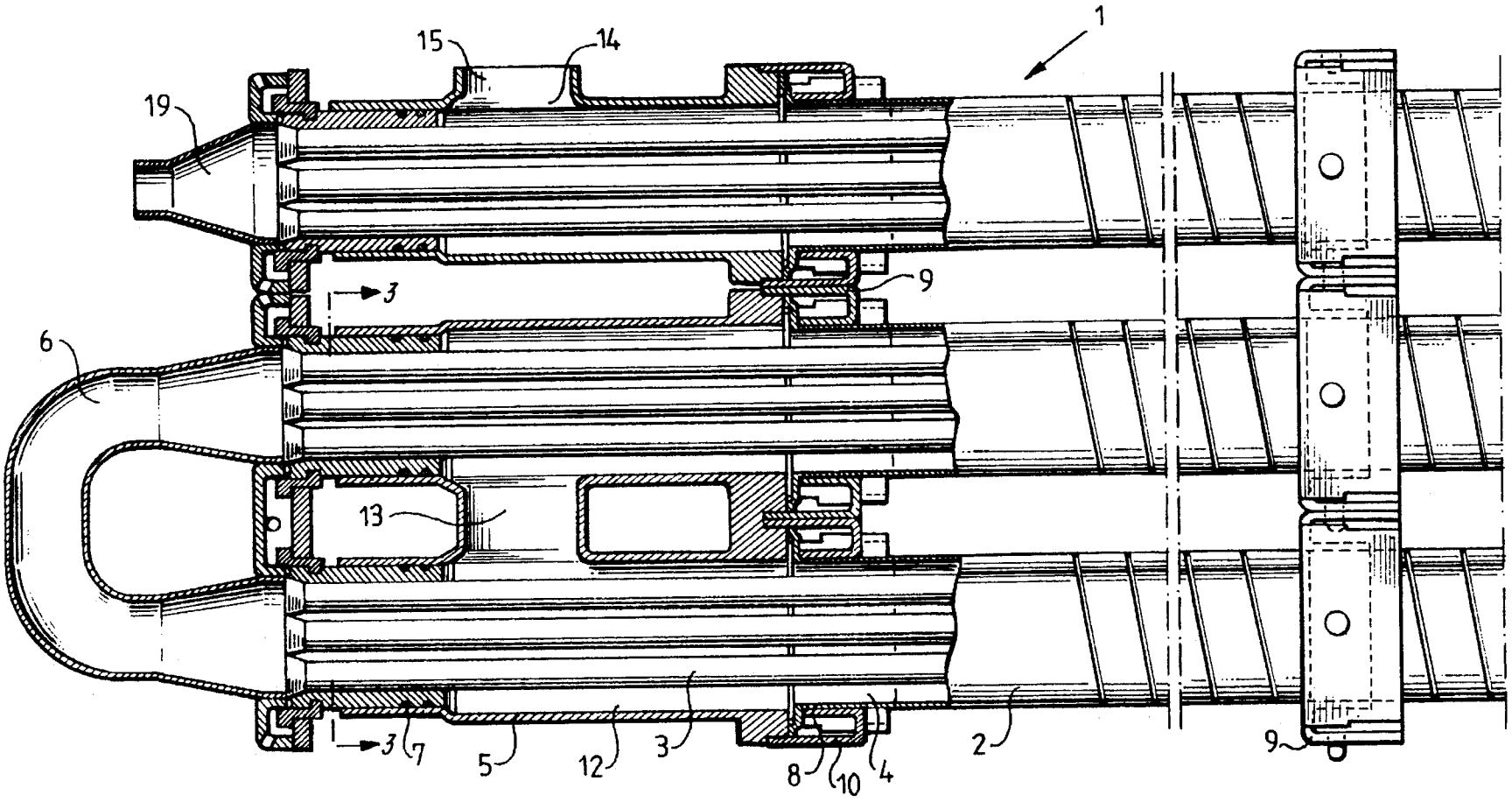
FIG. 2 is a plan view of a part of a heat exchanger, partly in section.

FIG. 2 shows a part of a heat exchanger with three heat exchanger elements 1. Each heat exchanger element 1 consists of an outer tubular jacket 2 in which there are disposed a number of thermal transfer tubes 3. A modular unit 4 is fixedly secured at each end of the tubular jacket 2 of the heat exchanger elements 1. A jacket connection 5 is fixedly mounted on two neighbouring modular units 4. As a result, the jacket connection 5 will constitute an extension of the tubular jacket 2 and will thereby surround the extension of the thermal transfer tubes 3.

At each respective end, the thermal transfer tubes 3 are fixedly welded into a tube plate 22 so that they together constitute a product flow insert. These product flow inserts are interconnected to one another by product elbow pipes 6 or a product connection 19. This product flow insert of conventional type is inserted into the jacket connection 5 against one or more gaskets 7 so that the product flow insert is movable relative to the tubular jacket 2 and the jacket connection 5.

Figure 3:
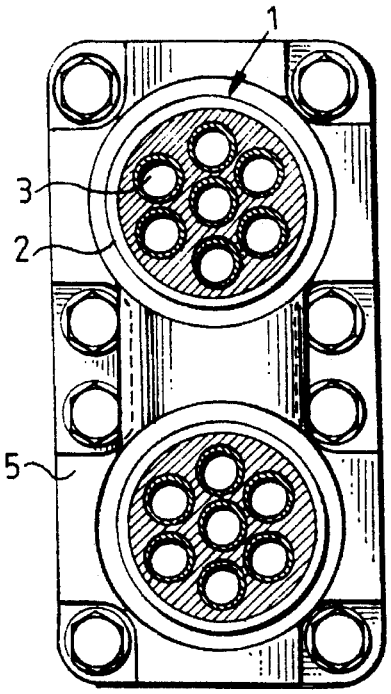
FIG. 3 is a section taken along the line 3—3 in FIG. 2.

FIG. 3 shows a cross section through FIG. 2, taken along the line 3—3, where the thermal transfer tubes 3 are seen as disposed within their tubular jacket 2. The Drawing also shows one end of the jacket connection 5, which is fixedly connected by screw connections to two modular units 4.

Figure 4:
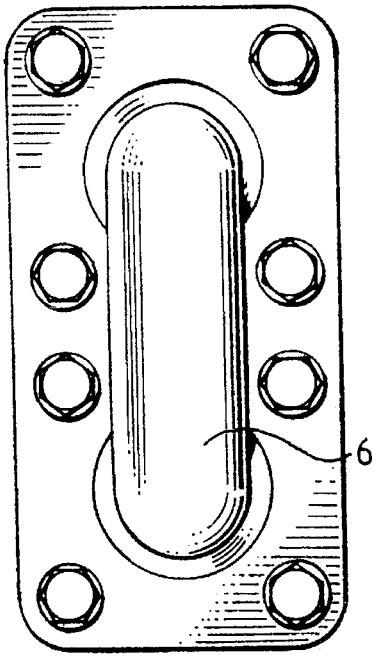
FIG. 4 is an end elevation of a part of a heat exchanger.

FIG. 4 shows an end elevation of a part of a heat exchanger with two heat exchanger elements 1 and the outer elbow pipe which constitutes the product elbow pipe 6. The product elbow pipes 6 are kept in place by a flange coupling against the product flow inserts.

Figure 5:
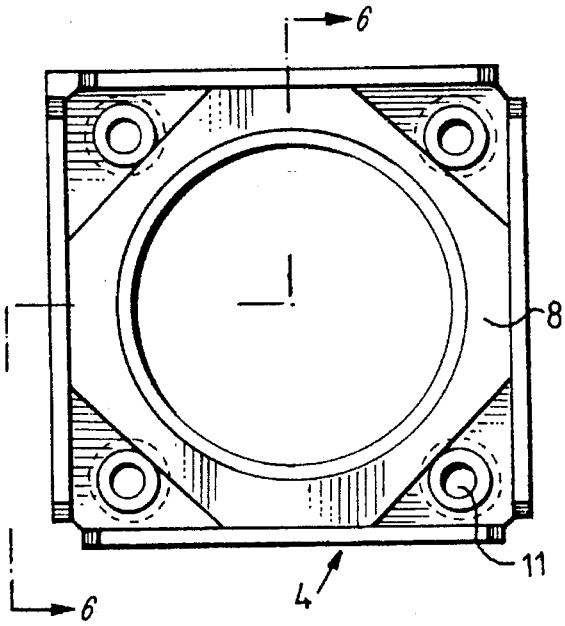
FIG. 5 is a plan view of a modular unit.
Figure 6:
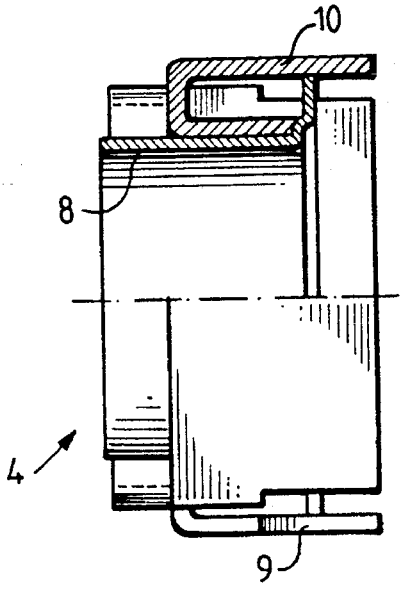
FIG. 6 is a section taken along the line 6—6 in FIG. 5.

FIGS. 5 and 6 show a modular unit 4. The modular unit 4 may, as in the preferred embodiment, consist of two parts, a flange section 8 which is welded to each end of the tubular jacket 2 and a module piece 9 loosely mounted on the flange section. These two parts 8 and 9 may of course be of one piece construction. The flange section 8 may further constitute an extension of the tubular jacket 2 on which the module piece 9 is mounted. The module piece 9 has screw holes 11 for the connection to the jacket connection 5. The module piece 9 further displays sliding surfaces 10 which are intended to abut against the sliding surface 10 on the immediately adjacent modular unit 4.

The module pieces 9 will hereby constitute the frame of the complete heat exchanger and the sliding surfaces 10 take up the loading of the heat exchanger elements 1 interconnected in the heat exchanger. At the same time, the sliding surfaces 10 allow the heat exchanger elements 1 to move towards one another and thus compensate for the thermal action to which the heat exchanger elements 1 are subjected.

In those cases when use is made of extremely long heat exchanger elements, of the order of up to 6 meters, one module piece 9 may be employed for supporting the heat exchanger elements 1 in their central region.

Figure 7:
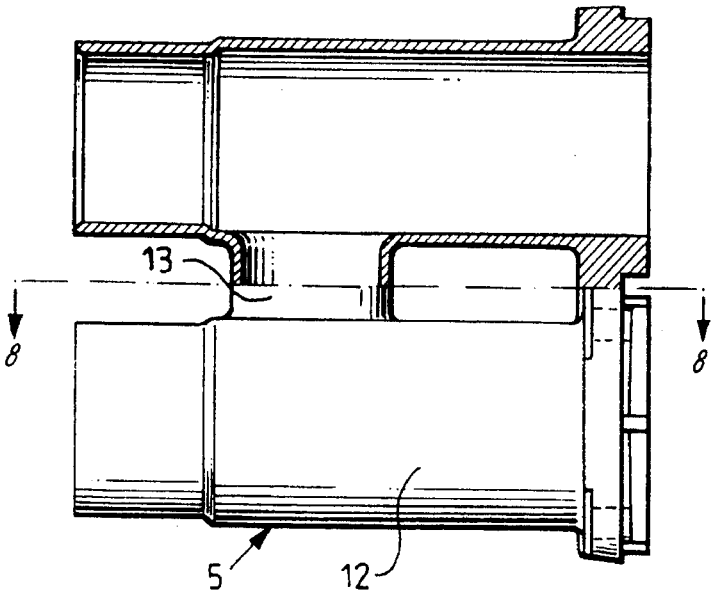
FIG. 7 is a plan view of a jacket connection, partly in section.
Figure 8:
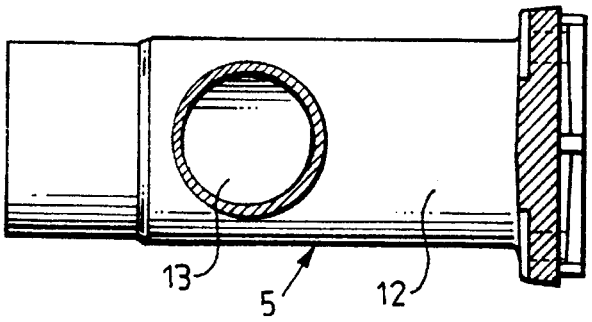
FIG. 8 is a section taken along the line 8—8 in FIG. 7.

FIGS. 7 and 8 show a jacket connection 5 which substantially consists of an H pipe with two parallel pipe branches, two tubular elements 12 and a connecting element 13 extending at right angles and communicating between these tubular elements 12. The inner diameter of the tubular elements 12 is approximately 0–10 per cent greater than the inner diameter of the tubular jacket 2 of the heat exchanger element 1, which assists in reducing the flow resistance in the thermal transfer medium when this passes through the jacket connection 5. Reduced flow resistance contributes in being able to reduce the capacity of those pumps which are connected to the heat exchanger.

One end of the two tubular elements 12 is screwed in place against the module piece on two neighbouring modular units 4. Once a product flow insert with its thermal transfer tubes has been inserted into the tubular jacket 2 and jacket connection 5, the product flow inserts will be interconnected with a product elbow pipe 6 or a product connection 19 for inflow or outflow of product to or from the heat exchanger.

Figure 9:
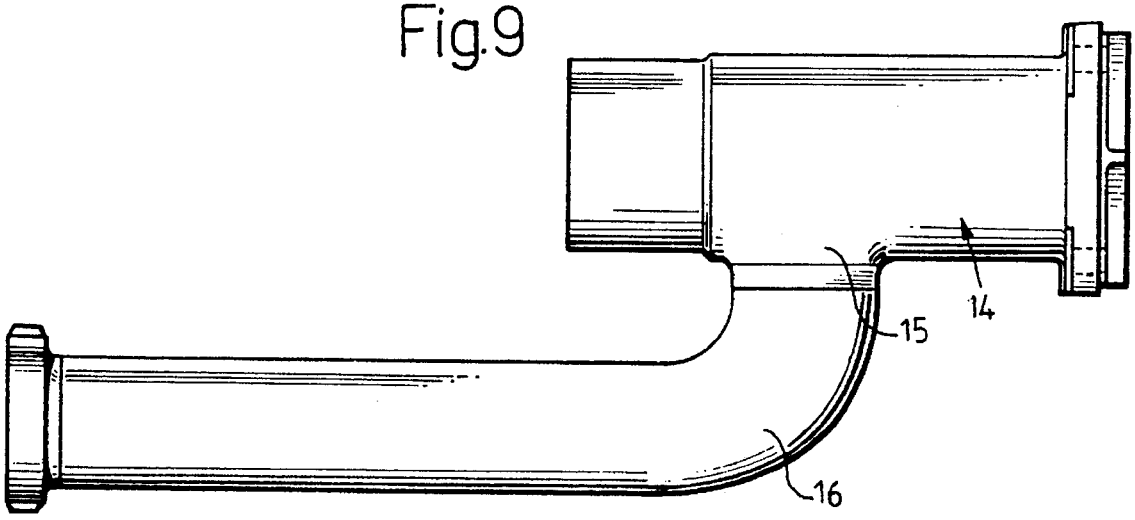
FIG. 9 is a plan view of half of a jacket connection with inlet or outlet connection.

FIG. 9 shows a jacket connection 14 which constitutes only half of the H pipe 5 as described above. This jacket connection 14 is employed for inflow or outflow of the thermal transfer medium. An elbow pipe 16 is connected to the open pipe socket 15 which is hereby formed for inlet or outlet of thermal transfer medium.

Figure 10:
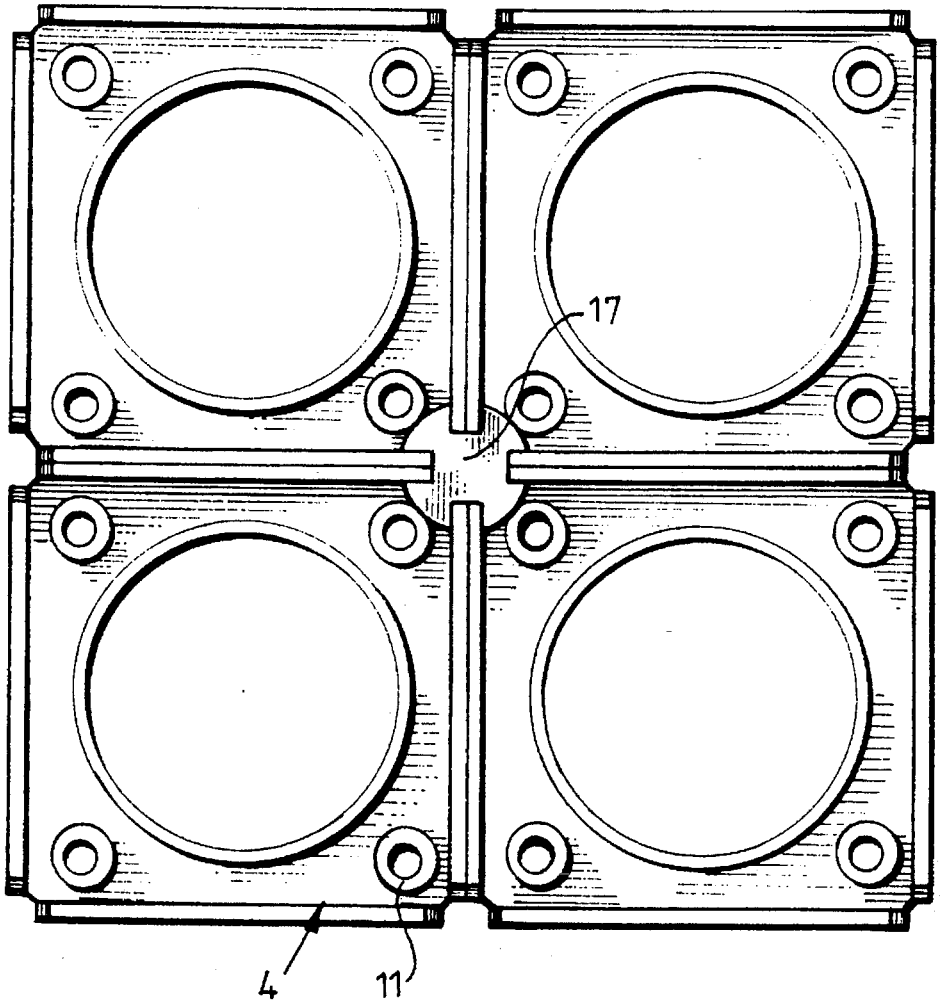
FIG. 10 is a plan view of a number of interconnected modular units.
Figure 11:
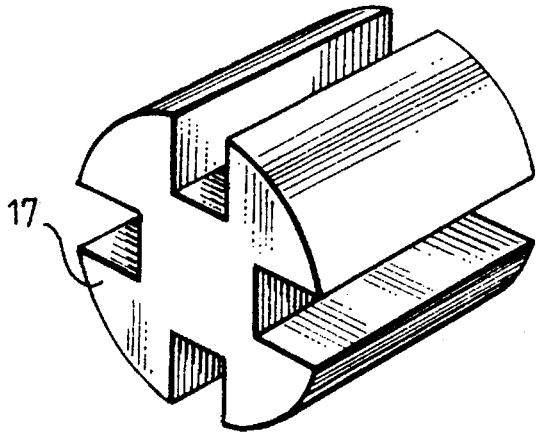
FIG. 11 is a plan view of a connection profile.

FIG. 10 shows four mutually adjacent modular units 4 which, in their common corner, are joined together by a coupling profile 17. The appearance of the coupling profile 17 may be varied but substantially consists of a cruciform profile which is loosely inserted into the module piece 9 on the modular unit 4 so that the coupling profile 17 configurationally stably engages with the grooves of the module piece 9. The coupling profile 17 is locked in its one end, in that it abuts against the screw connection between the modular units 4 and the jacket connection 5. The substantially cruciform coupling profile 17 may be made of metal, preferably stainless steel, but it may also be manufactured from polymers or ceramics.

Because of their design, the modular units 4 will constitute an almost homogeneous wall in a heat exchanger, and this almost homogeneous wall is intended to prevent the occurrence of the inherent convection which may occur within the heat exchanger because of temperature differences in the various parts of the heat exchanger. In those cases when use is made of a module piece 9 for supporting the central region of a long heat exchanger element 1, this module piece 9 is not entirely homogenous, but ventilation may occur between the different sections. In this case, the module piece 9 thus solely serves a supporting function.

Figure 12:
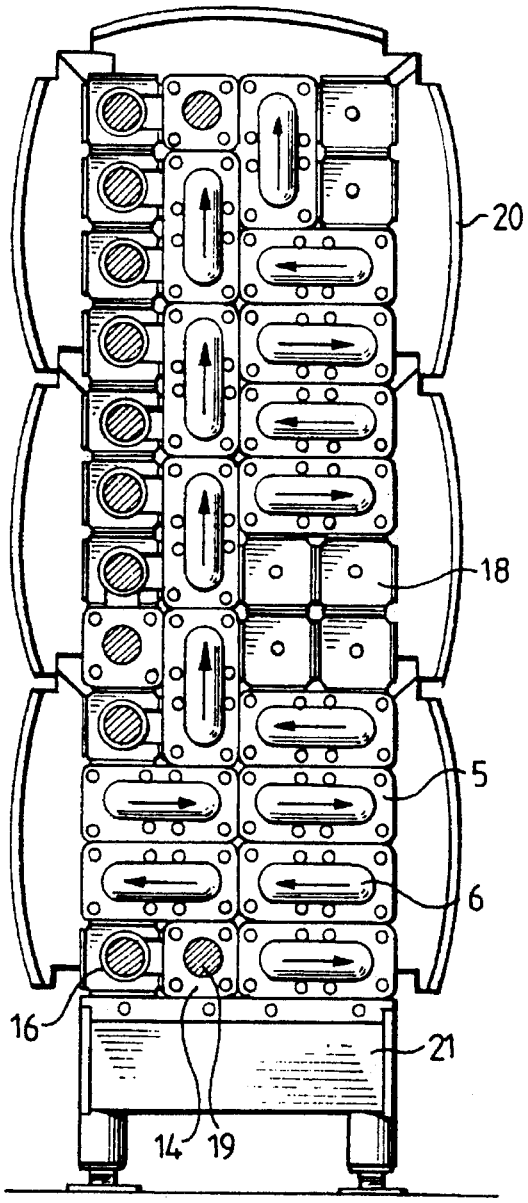
FIG. 12 is an end elevation of an assembled heat exchanger.
Figure 13:
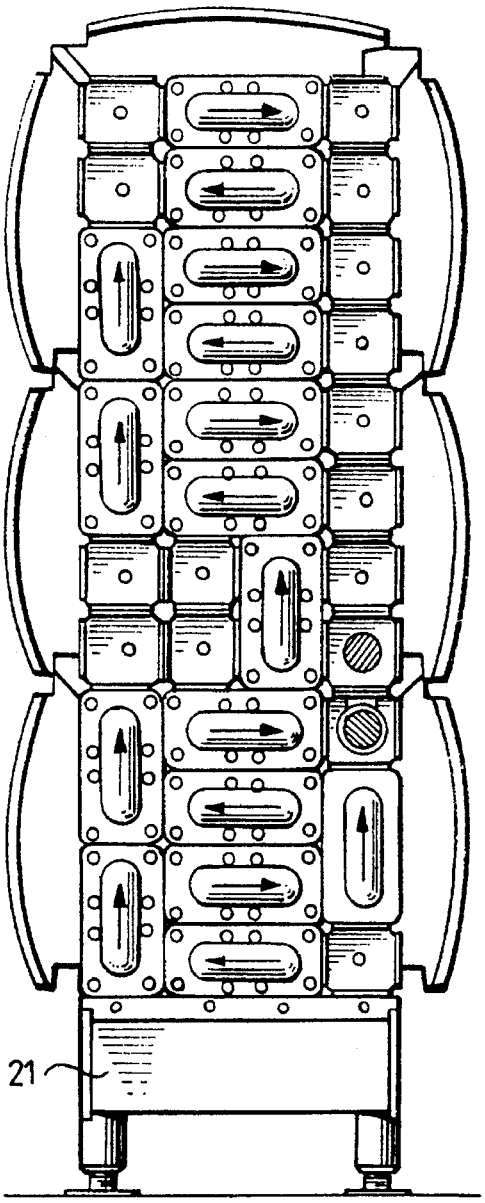
FIG. 13 is an end elevation of the same assembled heat exchanger.

FIGS. 12 and 13 show the two different side sections of a combined heat exchanger. By supplying product at different points in the heat exchanger and leading off the product through selected parts of the heat exchanger, and by introducing the thermal transfer medium at other points and leading off this medium therefrom, a co-ordinated unit will be created, of which the Drawings show but a single example. In those jacket connections 14 which are employed here according to the embodiment illustrated in FIG. 8, i.e. in inflow or outflow of thermal transfer medium, that elbow pipe 16 which constitutes the inlet or outlet conduit will occupy one modular place in the heat exchanger. Since this modular place then lacks a the heat exchanger element 1, a support corresponding to one modular unit 4 must be employed at this modular place. In such instance, use is made of a module piece 18 without the holes which are intended for tubular jacket 2 and thermal transfer tubes 3. This is necessary so as to provide the robustness and stability which are required to be able to build a complex heat exchanger.

FIGS. 12 and 13 also show how the finished, combined heat exchanger is provided on all sides with cover plates 20 which, in the Drawings, have been made gently arched so as thereby to increase the rigidity in the plate. The cover plates 20 are suitably secured in the module pieces 9. Cover plates 20 are employed when the heat exchanger elements reach elevated temperatures in relation to their ambient surroundings. The entire heat exchanger is mounted on a floor frame 21 for raising up the heat exchanger from the floor.

Figure 14:
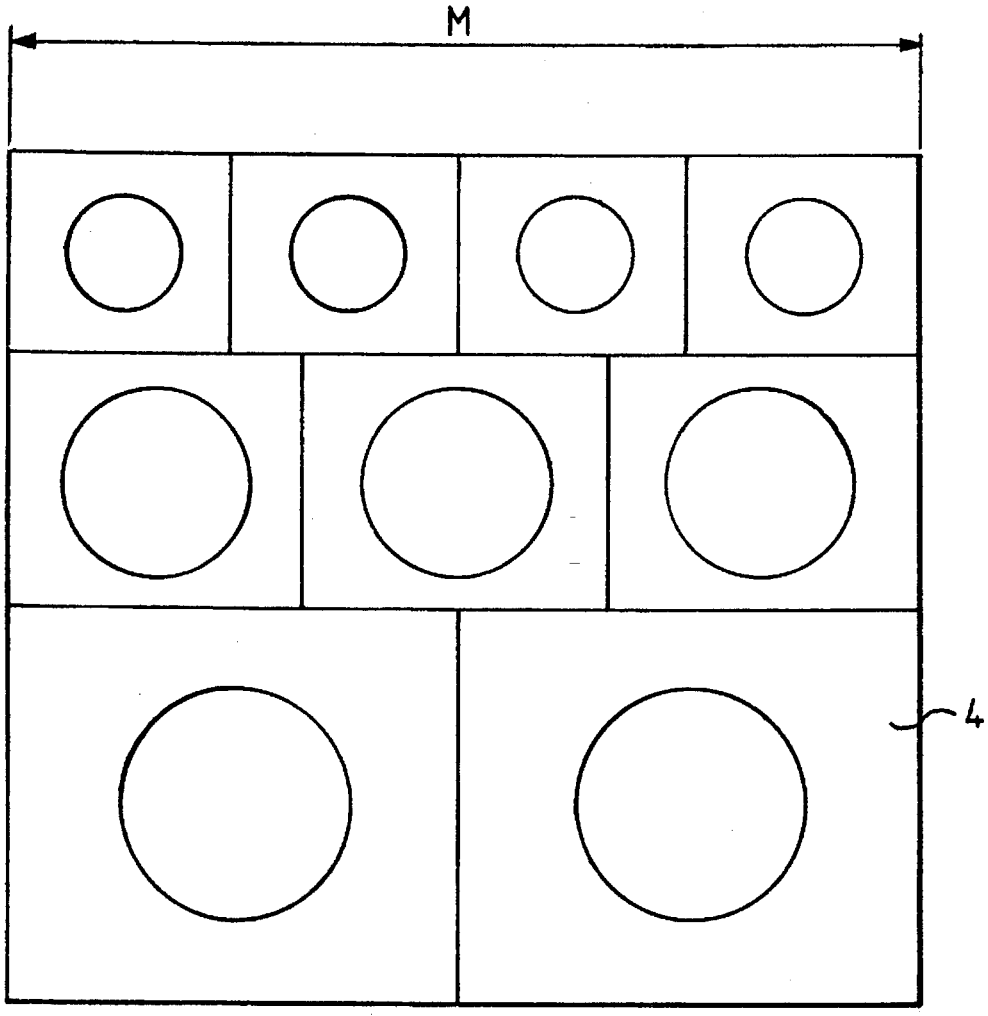
FIG. 14 is a schematic presentation of the other end of the modular adaptation of the modular units.

FIG. 14 shows how the modular units 4 may be included in a standardisation scheme so that one modular dimension M may encompass two, three, four or six module pieces depending upon the size and type of the heat exchanger element 1 which is employed.

A heat exchanger of the above-described type is easier to assemble than conventional tube heat exchangers. Furthermore, replacement of O gaskets and other spare parts is facilitated in that those parts of the heat exchanger which are located above that point where it is intended to replace spare parts need not be dismantled on spare part replacement. The only parts which need to be backed-off and loosened are a product elbow pipe and a jacket connection. This makes a major contribution in reducing the costs for assembly and maintenance of the heat exchanger.

As will have been apparent from the foregoing description, the present invention realises a heat exchanger which may, to a considerable extent, be standardised and modularised and whose units may be combined to form a single complete unit which is more compact and simpler to manufacture, assemble and modify than conventional tube heat exchangers.

The present invention should not be considered as restricted to that described above and shown on the Drawings, many modifications being conceivable without departing from the spirit and scope of the appended claims.

What is claimed is:

1. A heat exchanger comprising:

a plurality of heat exchanger elements having at least one heat transfer tube for conveying a first fluid and a tubular jacket surrounding said at least one heat transfer tube for conveying a second fluid;

a plurality of modular units connected to the tubular jackets for supporting the heat exchanger elements;

at least one jacket connection element having two tubular elements connected by a connecting element, said connecting element conveying said second fluid from one of said two tubular elements to the other, said at least one jacket connection element being connected at a first end to two neighboring tubular jackets by two of said modular units;

at least one elbow pipe connecting the heat transfer tubes in two neighboring heat exchanger elements for conveying said first fluid; and a coupling adapted to engage four mutually adjacent modular units.

2. The heat exchanger as claimed in claim 1, wherein the at least one jacket connection element is an H-shaped pipe having parallel tubular elements and a perpendicular connecting element.

3. The heat exchanger as claimed in claim 1, wherein said modular units are movably secured to one another by means of the coupling.

4. The heat exchanger as claimed in claim 1, wherein the coupling is substantially cross shaped and adapted to engage four mutually adjacent modular units.

5. The heat exchanger as claimed in claim 1, wherein the coupling is made of stainless steel.

6. The heat exchanger as claimed in claim 1, wherein the at least one jacket connection element is fixedly connected to two mutually adjacent modular units.

7. The heat exchanger as claimed in claim 1, further comprising at least one external fluid port connected to one of said tubular jackets by a modular unit for conveying said second fluid to or from said tubular jackets.

8. The heat exchanger as claimed in claim 1, further comprising at least one external fluid port connected to the heat transfer tubes of one of the heat exchanger elements for conveying said first fluid to or from said heat transfer tubes.

9. The heat exchanger as claimed in claim 1, wherein the modular units have a tubular portion and a flange, said tubular portion adapted to receive a tubular jacket.

10. The heat exchanger as claimed in claim 9, wherein the flange has screw holes for connecting the at least one jacket connection element to one of the tubular jackets.

11. The heat exchanger as claimed in claim 1, wherein the heat exchanger tubes extend through the tubular elements of the at least one jacket connection element.

12. The heat exchanger as claimed in claim 1, further comprising a tube plate mounted on the ends of the heat transfer tubes for preventing the second fluid from passing through a second end of the at least one jacket connection element.

13. The heat exchanger as claimed in claim 12, further comprising a plurality of gaskets for forming a liquid tight seal between the tube plate and the at least one jacket connection element.

14. A heat exchanger comprising:

a plurality of heat exchanger elements having at least one heat transfer tube for conveying a first fluid and a tubular jacket surrounding said at least one heat transfer tube for conveying a second fluid;

a plurality of modular units connected to the tubular jackets for supporting the heat exchanger elements;

at least one jacket connection element having two tubular elements connected by a connecting element, said connecting element conveying said second fluid from one of said two tubular elements to the other, said at least one jacket connection element being connected at a first end to two neighboring tubular jackets by two of said modular units;

at least one elbow pipe connecting the heat transfer tubes in two neighboring heat exchanger elements for conveying said first fluid; and wherein the modular units have a tubular portion and a flange, said tubular portion adapted to receive a tubular jacket, and each of the modular units has sliding surfaces adapted to abut the sliding surfaces on adjacent modular units.

15. A heat exchanger comprising:

a plurality of heat exchanger elements having one or more heat transfer tubes surrounded by a tubular jacket;

a plurality of modular units connected to the tubular jackets for providing a support frame for the heat exchanger elements, said modular units connected to one another such that the modular units are movable with respect to one another in response to expansion or contraction of the heat exchanger elements, wherein the modular units are connected to one another by means of a coupling profile adapted to engage four mutually adjacent modular units;

at least one jacket connection element connected to two of said tubular jackets by two of said modular units; and at least one elbow pipe connecting the heat transfer tubes of two heat exchanger elements.

16. The heat exchanger as claimed in claim 15, wherein the at least one jacket connection element is an H-shaped pipe having parallel tubular elements and a perpendicular connecting element.

* * * * *